US010086627B2

(12) United States Patent
Seki et al.

(10) Patent No.: US 10,086,627 B2
(45) Date of Patent: Oct. 2, 2018

(54) PRINTING DEVICE AND PRINTING METHOD FOR APPROPRIATELY SUPPRESS BLOCKING PROBLEM

(71) Applicant: MIMAKI ENGINEERING CO., LTD., Nagano (JP)

(72) Inventors: Akifumi Seki, Nagano (JP); Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/505,074

(22) PCT Filed: Aug. 25, 2015

(86) PCT No.: PCT/JP2015/073794
§ 371 (c)(1),
(2) Date: Feb. 18, 2017

(87) PCT Pub. No.: WO2016/031799
PCT Pub. Date: Mar. 3, 2016

(65) Prior Publication Data

US 2017/0266992 A1 Sep. 21, 2017

(30) Foreign Application Priority Data

Aug. 25, 2014 (JP) ..... 2014-170674

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS

2006/0040093 A1* 2/2006 Tani ..... B41J 11/002 428/195.1
2011/0090279 A1* 4/2011 Yanagi ..... B41M 5/0017 347/21

FOREIGN PATENT DOCUMENTS

JP 2003-191452 7/2003
JP 2003191452 A * 7/2003
(Continued)

OTHER PUBLICATIONS

"International Search Report (Form PCT/ISA/210)", dated Nov. 10, 2015, with English translation thereof, pp. 1-2.

*Primary Examiner* — Bradley Thies
(74) *Attorney, Agent, or Firm* — JCIPRNET

(57) ABSTRACT

Problems such as blocking are suppressed and more appropriately perform printing, in a case of using a configuration in which each medium is wound after printing. A printing device for performing printing on a medium includes a printing head configured to form an overcoat layer on the medium, an after-heater configured to heat the medium having the overcoat layer formed thereon, and a winding roller which is a medium winding unit configured to wind the medium heated by the after-heater, and the after-heater heats the medium such that the temperature of the overcoat layer becomes a temperature equal to or higher than a glass-transition point, and the winding roller winds the medium having a state where the temperature of the overcoat layer is a temperature lower than the glass-transition point.

12 Claims, 3 Drawing Sheets

(56) References Cited

FOREIGN PATENT DOCUMENTS

| | | | | | |
|---|---|---|---|---|---|
| JP | 2005-280175 | | | 10/2005 | |
| JP | 2014-138989 | | | 7/2014 | |
| JP | 2014138989 | A | * | 7/2014 | ..... B41J 2/2114 |

* cited by examiner

PRINTING DEVICE AND PRINTING METHOD FOR APPROPRIATELY SUPPRESS BLOCKING PROBLEM

CROSS-REFERENCE TO RELATED APPLICATION

This application is a 371 application of the international PCT application serial no. PCT/JP2015/073794, filed on Aug. 25, 2015, which claims the priority benefit of Japan application no. 2014-170674, filed on Aug. 25, 2014. The entirety of each of the above-mentioned patent applications is hereby incorporated by reference herein and made a part of this specification.

TECHNICAL FIELD

The present invention relates to a printing device and a printing method.

BACKGROUND ART

In the related art, a method of fowling a protective layer of a laminated film or the like in order to protect a printed matter having an image printed thereon is known. However, if this method is used to protect a printed matter, for example, during processing, wrinkles may occur, resulting in deterioration in the quality of the printed matter. Also, in a case of using uneven media such as tarpaulins, air bubbles may be generated therein.

Also, in recent years, large-sized inkjet printers have been widely used to produce printed matters such as outdoor advertisements to be installed outdoors (see Patent Literature 1 for instance). Further, in this case, printing may be performed on large-sized media. However, in a case of forming protective layers of laminated films, in general, the maximum width of processable media is about 1600 mm. For this reason, in general, laminating has not been performed on large-sized printed matters having widths exceeding 1600 mm.

CITATION LIST

Patent Literature

Patent Literature 1: JP-A-2005-280175

SUMMARY

Technical Problem

In order to protect printed matters, for example, it can also be considered to apply liquid over-coating agents on printed images, in place of covering with laminated films. Application of over-coating agents may be performed, for example, by methods using a spray, a brush, dipping, or the like.

However, if these methods are used to apply over-coating agents, for example, it is easy for unevenness of application to occur, and the visual quality of printing may deteriorate. Also, for example, over-coating agents may be applied even to blank parts having no drawn images, and thus it is easy for over-coating agents to be unnecessarily consumed. Further, for example, applying devices for applying over-coating agents are needed separately from printing devices, and thus maintenance may require a lot of time and effort.

With respect to this, in order to apply over-coating agents, it can also be considered to perform application by inkjet printers and the like, not by methods using a spray, a brush, dipping, or the like. Therefore, the inventors of this application first considered a configuration in which ultraviolet curing type clear ink is used as an over-coating agent and application of the over-coating agent is performed by an inkjet printer.

According to this configuration, for example, it is possible to irradiate applied clear ink with ultraviolet light, thereby hardening overcoat layers, whereby it is possible to improve the weather resistance of printed matters. Also, it is possible to apply clear ink in an inkjet scheme using an inkjet head, thereby appropriately suppressing occurrence of unevenness of application and evenly applying the clear ink. Further, it is possible to apply clear ink only to necessary areas, thereby reducing clear ink usage. Furthermore, it is possible to perform drawing of images and applying of clear ink by one inkjet printer, and thus it is possible to reduce time and effort for maintenance.

However, the inventors of this application found out that, in a case of forming an overcoat layer with ultraviolet curing type clear ink, it may be difficult to sufficiently improve the strength of the overcoat layer, by earnest research. Also, they found out that the reason is that the strength after hardening is influenced by some factors such as a factor in which the amounts and number of types of additives included in ultraviolet curing type clear ink and necessary for hardening the ink are large.

For this reason, in a case of forming overcoat layers in the inkjet scheme, it is desired to form overcoat layers with ink having a more appropriate composition. Therefore, an object of the present invention is to provide a printing device and a printing method capable of solving the above-described problems.

Solution to Problem

The inventors of this application conducted more earnest research on methods of forming overcoat layers in the inkjet scheme. Then, they considered using ink fixable to media by heating, not ultraviolet curing type ink, as clear ink for forming overcoat layers. In this case, ink fixable to media by heating means, for example, ink fixable to media by volatilizing some components of the ink by heating. Also, components of ink which are volatilized are, for example, water, organic solvents, and the like. More specifically, ink fixable to media by heating is, for example, latex ink, solvent ink, and the like. According to this configuration, it is considered that it is possible to appropriately reduce some components of clear ink such as unnecessary additives. Also, it is considered that this can appropriately improve the strengths of overcoat layers.

Meanwhile, the inventors actually conducted experiments and the like, and confirmed that just using such ink may cause new problems. More specifically, for example, in order to sufficiently improve the weather resistance of an overcoat layer, it is required to apply a sufficient amount of clear ink and sufficiently perform heating after the application. Meanwhile, in order to appropriately complete an overcoat layer in a practical time, it is impossible to excessively lengthen a medium heating time. For this reason, during heating after application of clear ink, for example, in order to reduce a time required for heating, it is required to sufficiently increase the heating temperature.

However, in a case of increasing the medium heating temperature, it is feared that it may be easy for problems such as blocking to occur. In this case, blocking means a phenomenon in which if media are stacked after printing, at least a part of ink on a medium adheres to the rear surface of its upper medium, and when the media are separated, the printing surface peels off. Also, blocking can be referred to as a state where offset occurs.

Further, it can be considered to perform formation of an overcoat layer during production of a printed matter for an advertising purpose or the like. Also, for this purpose, for example, media which can be wound in a roll shape after printing are widely used. Therefore, in a case of using these media, in general, configurations in which each medium is subsequently wound as printing progresses are used. Therefore, it is considered that it is especially easy for problems such as blocking to occur.

With respect to this, the inventors of this application found out that if the temperature of an overcoat layer during winding is equal to or higher than a glass-transition point, it is easy for problems such as blocking to occur, by more earnest research. Also, the inventors found out that if the temperature of an overcoat layer during winding is less than the glass-transition point, it is possible to appropriately suppress problems such as blocking. Also, the inventors of this application found out that even in a case of using ink other than clear ink in a configuration in which each medium is wound, it is possible to perform heating by the same method, thereby capable of appropriately suppress problems such as blocking. In order to solve the above-described problems, the present invention has the following configurations.

(First Configuration)

A printing device for performing printing on a medium includes a printing head configured to form an ink layer on the medium, a heater configured to heat the medium having the ink layer formed thereon, and a medium winding unit configured to wind the medium heated by the heater, wherein the heater heats the medium such that the temperature of the ink layer becomes a temperature equal to or higher than a glass-transition point, and the medium winding unit winds the medium having a state where the temperature of the ink layer is a temperature lower than the glass-transition point.

In this configuration, for example, it is possible to appropriately and sufficiently heat ink on a medium, for example, by sufficiently increasing the heating temperature of the heater. Also, in this way, for example, it is possible to fix ink to a medium in a short time. Further, for example, even in a case of performing high-speed printing, it is possible to appropriately fix ink to a medium in a time within a practical range.

Also, in this configuration, for example, since a medium having a state where the temperature of an ink layer is a temperature lower than the glass-transition point is wound, it is possible to appropriately suppress problems such as blocking. Therefore, according to this configuration, for example, in a case of using a component for winding a medium after printing, it is possible to suppress problems such as blocking and more appropriately perform printing.

Also, in this configuration, the printing head is, for example, a printing head (an overcoat head) for forming an overcoat layer such as a clear layer. In this case, the printing device may further include a printing head for drawing an image on a medium with colored ink (a head for colored ink). Also, the overcoat head applies ink such as clear ink, for example, on an image drawn by the head for colored ink. Also, for example, the printing device may perform only image drawing with colored ink, without forming an overcoat layer. In this case, the printing head may be, for example, a head for colored ink.

Also, for example, in a case where the printing device 10 includes a plurality of heaters, all or some of the heaters may heat a medium such that the temperature of an ink layer becomes a temperature equal to or higher than the glass-transition point. For example, such a heater for performing heating may be an after-heater. An after-heater is, for example, a heater which is installed on the downstream side from the printing head in the medium conveyance direction. Also, a situation where the medium winding unit winds a medium having a state where the temperature of an ink layer is a temperature lower than the glass-transition point means a situation where the medium winding unit winds the medium having a state where the temperature of a portion to be wound on the medium winding unit (a wound portion) is a temperature lower than the glass-transition point. Also, the temperature of an ink layer may be, for example, the temperature of the surface of the ink.

Also, with respect to the temperature of an ink layer during winding, if a time from when heating of the heater (such as an after-heater) finishes to when the medium starts to be wound is sufficiently set, it is possible to appropriately lower the temperature. In this case, more specifically, for example, it can be considered to sufficiently set the medium conveyance distance from the heater to the medium winding unit. Also, after heating of the heater, the temperature of an overcoat layer may be lowered, for example, by a cooling fan or the like.

(Second Configuration)

The printing head is an inkjet head configured to eject ink drops toward a medium. According to this configuration, for example, it is possible to appropriately form an ink layer on a medium.

(Third Configuration)

The printing head forms an ink layer to be fixed to a medium by drying, on the medium. According to this configuration, for example, it is possible to appropriately form an ink layer on a medium. Ink which is fixed to media by drying is, for example, latex ink, solvent ink, or the like.

(Fourth Configuration)

The printing head is an overcoat head configured to form an overcoat layer which is an ink layer covering an image drawn on the medium with colored ink. In this case, the image drawn on the medium with the colored ink is, for example, letters, patterns, and the like drawn on the medium. Also, the overcoat layer is, for example, a clear layer which is formed with clear ink, and protects the image drawn with the color ink by covering the colored ink layer. According to this configuration, for example, it is possible to appropriately form an overcoat layer on a medium. Also, in this way, for example, it is possible to appropriately improve the weather resistance of a printed matter.

Also, in this case, for example, with respect to ink for overcoat layers, it is possible to appropriately reduce additives and the like to be contained in the ink, as compared to a case of using ultraviolet curing type ink. Also, in this way, it is possible to more appropriately improve the strength of overcoat layers. Therefore, according to this configuration, for example, it is possible to more appropriately form overcoat layers.

(Fifth Configuration)

The printing head includes a head for colored ink which is a printing head configured to draw an image on a medium with color ink, and the overcoat head, and the heater heats a medium such that the temperature of an overcoat layer becomes a temperature equal to or higher than the glass-transition point, and the medium winding unit winds the medium having a state where the temperature of the overcoat layer is a temperature lower than the glass-transition point.

According to this configuration, for example, it is possible to appropriately perform drawing of an image with colored ink and formation of an overcoat layer by one printing device. Therefore, according to this configuration, for example, it is possible to appropriately reduce time, effort, and the like for maintenance of the device. Also, it is possible to appropriately fix an overcoat layer to a medium by sufficiently performing heating by the heater after formation of the overcoat layer. Also, it is possible to appropriately suppress problems such as blocking by winding a medium after sufficiently lowering the temperature of an overcoat layer. Therefore, according to this configuration, for example, it is possible to more appropriately form overcoat layers.

Also, as the colored ink, a variety of well-known ink may be used. For example, it is possible to suitably use latex ink, solvent ink, and the like. Also, as the colored ink, for example, ultraviolet curing type ink (UV ink), solvent UV ink, and the like may be used.

(Sixth Configuration)

The overcoat head foil is a transparent and clear ink layer, as an overcoat layer, on a medium. According to this configuration, for example, it is possible to appropriately form overcoat layers.

(Seventh Configuration)

The overcoat head forms an ink layer containing an ultraviolet absorbing agent absorbing ultraviolet light, as an overcoat layer, on a medium. According to this configuration, for example, it is possible to more appropriately improve the weather resistance of overcoat layers.

For example, in a case of installing printed matters outdoors, in general, the surfaces of the printed matters are significantly influenced by ultraviolet light. For this reason, in order to improve the weather resistance of overcoat layers, it is effective to form overcoat layers with ink containing an ultraviolet absorbing agent. However, for example, in a case of forming overcoat layers with ultraviolet curing type ink, since it is required to harden the ink by irradiation with ultraviolet light, in general, it is impossible to include an ultraviolet absorbing agent in the ink.

In contrast, in a case of using ink fixable to media by heating (such as latex ink), it is unnecessary to irradiate the ink with ultraviolet light for fixing the ink. Therefore, in this case, it is possible to use ink containing an ultraviolet absorbing agent. Therefore, according to this configuration, it is possible to appropriately reduce the influence of ultraviolet light on overcoat layers. Also, in this way, as described above, for example, it is possible to more appropriately improve the weather resistance of overcoat layers.

(Eighth Configuration)

The overcoat head forms a layer of latex ink or solvent ink, as an overcoat layer, on a medium. According to this configuration, for example, it is possible to appropriately form overcoat layers.

Also, latex ink is, for example, ink containing a resin or a resin emulsion. Also, latex ink may be, for example, ink which contains a polymer material and a solvent and in which the polymer material is fixed to media by drying. The polymer material is, for example, an aqueous polymer material. Also, the polymer material may be, for example, a rubber-like polymer material. In a case of using latex ink, for example, it is possible to appropriately form a resin layer of a polymer material or the like as an overcoat layer. Also, in this way, it is possible to appropriately form overcoat layers with high weather resistance.

(Ninth Configuration)

The printing device further includes a powdering device installed between the heater and the medium winding unit, and configured to disperse powder toward a medium before the medium is wound by the medium winding unit. For example, it is preferable that the powdering device disperse the powder toward a medium having a state where the temperature of an overcoat layer is lower than the glass-transition point.

The inventors of this application found out that, if the powder is dispersed toward a medium before the medium is wound by the medium winding unit, it is possible to more appropriately suppress problems such as blocking, by more earnest research. According to this configuration, for example, it is possible to more appropriately wind a medium after formation of an overcoat layer.

Also, as the powder, it is possible to suitably use powder having a diameter of about 10 μm or less. Also, as the powder, it is possible to suitably use powder of, for example, starch, silica, or the like.

(Tenth Configuration)

A printing method of performing printing on a medium includes: forming an ink layer on the medium by a printing head; heating the medium having the ink layer formed thereon, by a heater; and winding the medium heated by the heater, by a medium winding unit, wherein the heater heats the medium such that the temperature of the ink layer becomes a temperature equal to or higher than a glass-transition point, and the medium winding unit winds the medium having a state where the temperature of the ink layer is a temperature lower than the glass-transition point. According to this configuration, for example, it is possible to achieve the same effects as those of the first configuration.

(Eleventh Configuration)

A printing device for performing printing on a medium includes an overcoat head which is a printing head configured to form an overcoat layer which is an ink layer covering an image drawn on the medium with colored ink, wherein the overcoat head forms an ink layer containing an ultraviolet absorbing agent absorbing ultraviolet light, as the overcoat layer, on the medium. According to this configuration, for example, it is possible to appropriately form overcoat layers with high weather resistance.

(Twelfth Configuration)

The overcoat head forms a layer of latex ink or solvent ink, as an overcoat layer, on the medium. According to this configuration, for example, it is possible to appropriately form overcoat layers.

(Thirteenth Configuration)

A printing method of performing printing on a medium includes forming an overcoat layer by an overcoat head which is a printing head configured to form an overcoat layer which is an ink layer covering an image drawn on a medium with colored ink, wherein an ink layer containing an ultraviolet absorbing agent absorbing ultraviolet light is formed as the overcoat layer on the medium. According to this configuration, for example, it is possible to achieve the same effects as those of the eleventh configuration.

Advantageous Effects of Invention

According to the present invention, in a case of using a component for winding media after printing, it is possible to suppress problems such as blocking and more appropriately perform printing.

BRIEF DESCRIPTION OF DRAWINGS

FIG. 1A shows an example of the configuration of a main part of the printing device 10. FIG. 1B shows an example of the configuration of a powdering device 60 of the printing device 10. FIG. 1C shows an example of an ink layer which is formed by the printing device 10.

FIG. 2A is a sectional side view of the serial powdering unit 62. FIG. 2B is a top view of the serial powdering unit 62.

DESCRIPTION OF EMBODIMENTS

Figure 1A:
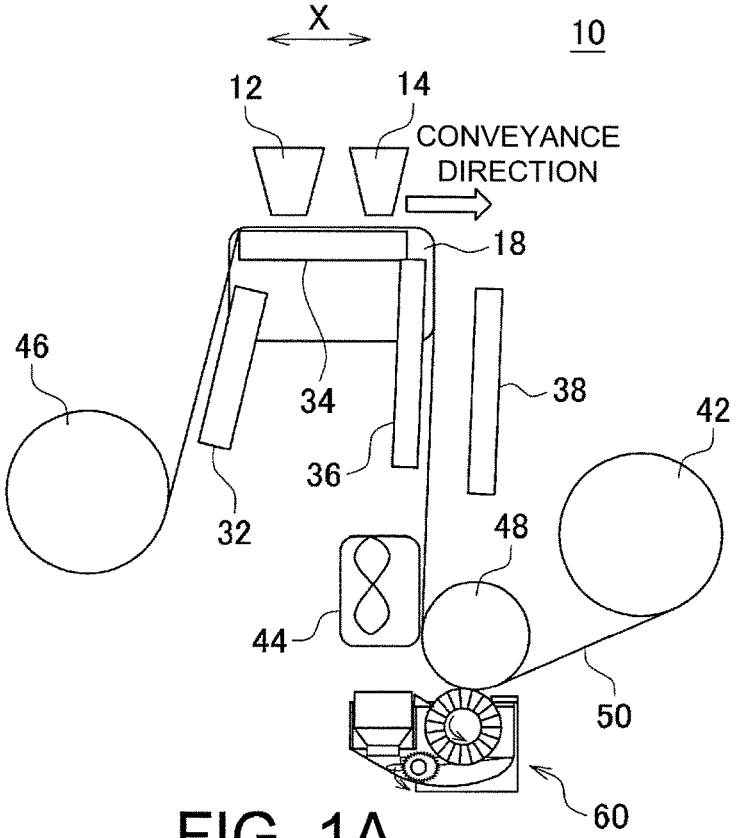
FIGS. 1A-1C are views illustrating an example of a printing device 10 according to an embodiment of the present invention.
Figure 1B:
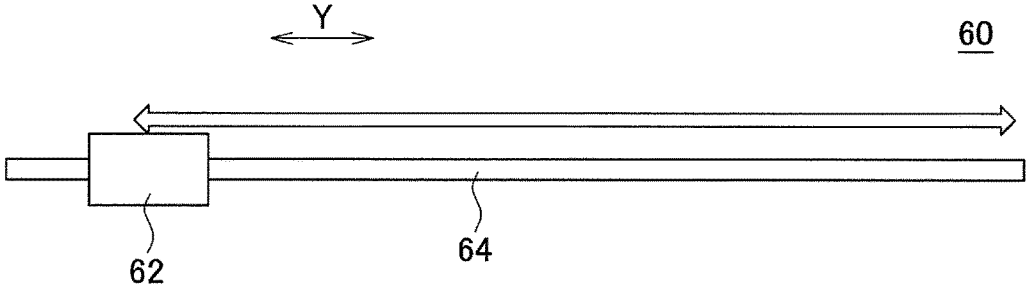
Figure 1C:
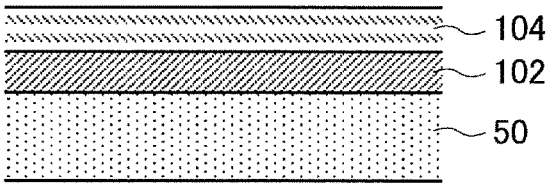

Hereinafter, embodiments of the present invention will be described with reference to drawings. FIGS. 1A-1C show an example of a printing device 10 according to an embodiment of the present invention. FIG. 1A shows an example of the configuration of a main part of the printing device 10. FIG. 1B shows an example of the configuration of a powdering device 60 of the printing device 10. FIG. 1C shows an example of an ink layer which is formed by the printing device 10.

In the present example, the printing device 10 is an inkjet printer for performing printing on media 50 in an inkjet scheme. Also, the printing device 10 uses medium 50 which can be wound after printing, and performs printing while conveying a medium 50 in a predetermined conveyance direction by sequentially winding a part of the medium 50 subjected to printing. Also, in this way, the printing device 10 produces large-sized printed matters for an advertising purposes and the like. Media 50 which are used in the printing device 10 may be, for example, large-sized media having widths larger than 1600 mm. Also, in the present example, the printing device 10 includes a head 12 for color ink, a head 14 for clear ink, a platen 18, a pre-heater 32, a platen heater 34, an after-heater 36, a far-infrared heater 38, a winding roller 42, an unwinding roller 46, the powdering device 60, an intermediate roller 48, and a cooling fan 44.

The head 12 for color ink is an example of a head for colored ink using colored ink having various colors, such as Y, M, C, and K ink. In the present example, the head 12 for color ink is an inkjet head for color ink, and the head 12 for color ink ejects ink drops of color ink onto a medium 50, thereby forming a colored ink layer 102 which is a layer of colored ink, on the medium 50. Also, in this way, the head 12 for color ink draws an image on a medium 50, for example, using colored ink.

Also, it can be considered to use a variety of well-known ink as colored ink which is used in the head 12 for color ink. For example, it is possible to suitably use latex ink, solvent ink, and the like. Also, it can be considered to use, for example, ultraviolet curing type ink (UV ink), solvent UV ink, and the like, as colored ink. In this case, the printing device 10 may further include, for example, an ultraviolet light source.

Also, the printing device 10 may include, for example, a plurality of heads 12 for color ink for ejecting ink drops of different colors, respectively. For example, the printing device 10 may include heads 12 for color ink of Y, M, C, and K.

Also, in a case where the printing device 10 includes a plurality of heads 12 for color ink, the plurality of heads for color ink is arranged side by side, for example, in a predetermined main scan direction (a Y direction) in the printing device 10. In this case, in each main scan operation, the plurality of heads 12 for color ink ejects ink drops to the same area on a medium 50. A main scan operation is, for example, an operation in which the inkjet heads eject ink drops while moving in the main scan direction.

The head 14 for clear ink is an example of an overcoat head, and fauns an overcoat layer 104 on a colored ink layer 102. In this case, an overcoat layer 104 is, for example, an ink layer covering an image drawn on a medium 50 with colored ink by the head 12 for color ink. Also, in the present example, the head 14 for clear ink is an inkjet head for ejecting ink drops toward a medium 50, and ejects ink which is a material for overcoat layers 104, onto a colored ink layer 102, thereby fowling an overcoat layer 104 covering the colored ink layer 102, for example, as shown in FIG. 1C. Also, an overcoat layer 104 is, for example, an ink layer which is formed with clear ink, and is formed so as to cover a colored ink layer 102, thereby protecting the colored ink layer 102. Clear ink is, for example, transparent clear ink.

Also, in the present example, the head 14 for clear ink forms an ink layer fixable to media 50 by drying, as an overcoat layer 104, on a medium 50. Ink which is fixed to media 50 by drying may be, for example, ink which is fixed to media 50 by volatilizing a solvent contained in the ink. Also, more specifically, ink which is fixed to media 50 by drying is, for example, latex ink, solvent ink, and the like.

Also, latex ink is, for example, ink containing a resin or a resin emulsion. Also, latex ink may be, for example, ink which contains a polymer material and a solvent and in which the polymer material is fixed to media by drying. The polymer material is, for example, an aqueous polymer material. Also, the polymer material may be, for example, a rubber-like polymer material.

Also, solvent ink is, for example, ink using an organic solvent as a solvent. The organic solvent is, for example, a hydrophobic organic solvent. Also, the organic solvent may be a volatile organic solvent. Also, solvent ink may be, for example, ink containing an organic solvent as its main component. Containing an organic solvent as a main component means, for example, that the content of the organic solvent is larger than 50% by weight.

In a case of using such ink, for example, as compared to a case of using ultraviolet curing type ink, it is possible to appropriately reduce additives and the like to be contained in ink. In this way, it is possible to appropriately improve the strength of an overcoat layer 104. Therefore, according to this configuration, for example, it is possible to appropriately form an overcoat layer 104 having high weather resistance.

Also, it can be considered to use, for example, solvent UV ink, as ink which is fixed to media 50 by drying. Solvent UV ink is, for example, ink containing an ultraviolet curing type substance (such as a monomer or an oligomer), and an organic solvent which is a solvent. Solvent UV ink may be ink obtained by diluting ultraviolet curing type ink with an organic solvent.

Further, from among those types of ink, it is especially preferable to use latex ink as ink for the head 14 for clear ink. According to this configuration, for example, it is possible to appropriately form a resin layer of a polymer material or the like, as an overcoat layer 104. Also, in this way, it is possible to appropriately form overcoat layers having high weather resistance.

Also, it is preferable to use, for example, ink containing an ultraviolet absorbing agent absorbing ultraviolet light, as ink (clear ink) for the head 14 for clear ink. According to this configuration, for example, it is possible to more appropriately improve the weather resistance of overcoat layers 104.

Here, in a case of using, for example, ultraviolet curing type ink as clear ink, since it is required to harden the ink by irradiation with ultraviolet light, in general, it is impossible to include an ultraviolet absorbing agent in the ink. In contrast, in the present example, since clear ink such as latex ink is used, it is possible to use clear ink containing an ultraviolet absorbing agent. Therefore, according to the present example, it is possible to appropriately reduce the influence of ultraviolet light on overcoat layers 104.

Also, if the content of an ultraviolet absorbing agent is excessively increased, it is feared that the ultraviolet absorbing agent may influence the strengths of overcoat layers 104. Also, some types of ultraviolet absorbing agents generate heat if absorbing ultraviolet light. Further, this heat may influence the weather resistance of printed matters. For this reason, it is preferable to set the content of an ultraviolet absorbing agent to about 1% (for example, about 0.1% to 3%, more preferably, about 0.5% to 1.5%).

Also, in the present example, the head 14 for clear ink is installed so as to be deviated from the head 12 for color ink in a sub scan direction (an X direction) perpendicular to the main scan direction. Also, for example, during main scan operations of the head 12 for color ink, the head 14 for clear ink performs main scan operations while moving in the main scan direction together with the head 12 for color ink. In this way, in each main scan operation, the head 14 for clear ink ejects ink drops of clear ink onto a colored ink layer 102 formed by the head 12 for color ink. According to this configuration, for example, it is possible to appropriately form overcoat layers 104 on colored ink layers 102.

Also, in the present example, the head 14 for clear ink is installed, for example, so as to be apart from the head 12 for color ink in the sub scan direction. According to this configuration, for example, it is possible to appropriately and sufficiently set a time (a time lag) from when formation of a colored ink layer 102 at each position of a medium 50 is completed to when clear ink starts to be ejected thereto. Also, it is possible to appropriately adjust the time lag by adjusting the distance between the head 12 for color ink and the head 14 for clear ink. Therefore, according to this configuration, for example, it is possible to appropriately and sufficiently dry a colored ink layer 102 before the colored ink layer is covered with clear ink. Also, in this way, for example, it is possible to appropriately form an overcoat layer 104 on a colored ink layer 102 while preventing re-dissolution of the ink of the colored ink layer 102.

The platen 18 is a board-like member for holding a medium 50 such that the medium face the head 12 for color ink and the head 14 for clear ink. The pre-heater 32, the platen heater 34, the after-heater 36, and the far-infrared heater 38 are heating means for heating media 50, and heat media 50, thereby drying ink on the media 50. From among them, the pre-heater 32 is a heater which is installed on the upstream side from the head 12 for color ink in the conveyance direction of media 50, and preliminarily heats each position of a medium 50, before ink drops ejected from the head 12 for color ink land.

The platen heater 34 is a heater for heating media 50 at a position facing the head 12 for color ink and the head 14 for clear ink, and heats each medium 50 at the landing position of ink drops ejected from the individual inkjet heads. The after-heater 36 is a heater which is installed on the downstream side from the head 14 for clear ink in the conveyance direction of media 50, and heats each area of a medium 50 having a colored ink layer 102 and an overcoat layer 104 formed thereon. Also, the far-infrared heater 38 is a heater for heating media 50 without contact with the media 50, and is installed so as to face the printing surface of each medium 50, and heats each medium 50 having an overcoat layer 104 and the like formed thereon. Also, in the present example, for example, the far-infrared heater 38 is installed at a position facing the after-heater 36 with a medium 50 interposed therebetween. According to this configuration, for example, it is possible to effectively perform heating on a medium 50 having an overcoat layer 104 and the like formed thereon, from both sides. Also, since the far-infrared heater 38 is a heater which is installed on the downstream side from the head 14 for clear ink in the conveyance direction of media 50, it can be considered as being an after-heater. Also, the heating temperatures of the heaters such as the after-heater 36 will be described below in more detail.

The winding roller 42 is an example of a medium winding unit for winding a medium 50 heated by the heaters. In the present example, the winding roller 42 is installed on the downstream side from the after-heater 36 in the conveyance direction of media 50, thereby winding a medium 50 heated by the after-heater 36 and the like.

Also, in the present example, during sub scan operations, the winding roller 42 winds a medium 50, thereby conveying the medium 50. In this case, a sub scan operation is, for example, an operation of relatively moving the head 12 for color ink and the head 14 for clear ink in the sub-scan direction with respect to a medium 50 between main scan operations. Also, on the basis of this operation, in the present example, the sub scan direction is a direction parallel to the conveyance direction of media 50. The printing device 10 conveys a medium 50 between main scan operations, thereby subsequently changing areas of the medium 50 to be objects of individual main scan operations.

The unwinding roller 46 is a roller having an unprinted medium 50 wound thereon, and is installed on the upstream side from the head 12 for color ink in the conveyance direction of media 50, so as to subsequently unwind the medium 50 toward the position of the head 12 for color ink. For example, as the winding roller 42 winds the medium 50, the unwinding roller 46 may subsequently unwind the medium 50 by the wound amount.

The powdering device 60 is a device for dispersing powder onto media 50. The powdering device 60 is installed, for example, between the heaters and the winding roller 42, and disperses the powder onto a medium 50 before the medium is wound by the winding roller 42. In this case, a position between the heaters and the winding roller 42 means, for example, a position between a heater for heating medium 50 on the most downstream side in the conveyance direction of media 50 (for example, the after-heater 36 or the far-infrared heater 38) and the winding roller 42.

Also, in the present example, the powdering device 60 includes a serial powdering unit 62 and a shaft unit 64, for example, as shown in FIG. 1B. The serial powdering unit 62 is a powdering device (a powder dispersing device) for dispersing the powder toward a medium 50 while moving in the main scan direction (the Y direction). The shaft unit 64 is a shaft for guiding movement of the serial powdering unit 62 in the main scan direction. Also, in the present example, for example, the serial powdering unit 62 disperses the powder while reciprocating along the shaft unit 64. According to this configuration, the powdering device 60 disperses the powder toward each part of a medium 50 in a serial manner.

Also, as the powder, it is possible to suitably use powder having a diameter of about 10 μm or less. Also, as the powder, it is possible to suitably use powder of, for example, such as starch, silica, or the like.

Also, in the present example, the powdering device 60 disperses the powder toward the rear surface side of a medium 50 as shown in FIG. 1A. In this case, the rear surface of a medium 50 is the opposite surface of the medium 50 to a surface where a colored ink layer 102 and an overcoat layer 104 are formed. Also, the reason why the powder is dispersed toward a medium 50 will be separately described below. A more specific configuration of the serial powdering unit 62 will also be described below in more detail.

The intermediate roller 48 is a roller for supporting a medium 50 in a state where the intermediate roller faces the powdering device 60, and rotates with a medium 50 between the intermediate roller and the powdering device 60. The intermediate roller 48 may be, for example, a driven roller which rotates with movement of a medium 50. According to this configuration, for example, it is possible to more appropriately disperse the powder toward a medium 50.

The cooling fan 44 is a component for cooling media 50 at a position before each medium is wound on the winding roller 42. In the present example, the cooling fan 44 is installed between the after-heater 36 and the powdering device 60, so as to cool a medium 50 heated by the after-heater 36 at a position before the powdering device 60 disperses the powder toward the medium.

Also, for example, it is preferable that the cooling fan 44 be installed so as to face the surface of a medium 50 toward which the powder is dispersed. According to this configuration, for example, it is possible to appropriately cool each medium 50 before dispersing of the powder. More specifically, for example, in a case of dispersing the powder toward the rear surface of a medium 50, it is preferable that the cooling fan 44 be installed so as to face the rear surface of the medium 50.

Also, for example, it can be considered to perform cooling of media 50 by a method other than the method using the cooling fan 44. For example, in a case where a conveyance distance from the after-heater 36 to the powdering device 60 or the winding roller 42 is sufficiently long, the cooling fan 44 may be omitted such that media 50 may cool by heat dissipation during conveyance. Also, it can be considered to use, for example, a heat sink or the like installed so as to face the rear surface of a medium 50, as a component for cooling.

Due to the above-described configuration, according to the present example, it is possible to appropriate form a colored ink layer 102 and an overcoat layer 104 on a medium 50 which can be wound in a roll shape after printing. Also, after formation of the overcoat layer 104, it is possible to appropriately perform heating of the medium 50 and dispersing of the powder, before winding.

Also, in the present example, since both of a colored ink layer 102 and an overcoat layer 104 are formed by main scan operations, it is possible to appropriately form a colored ink layer 102 and an overcoat layer 104 in one process by applying color ink and clear ink at the same time. Therefore, for example, after formation of a colored ink layer 102, it is not necessary to reset a medium 50 in order to form an overcoat layer 104. Further, since overcoat layers 104 are formed in the inkjet scheme, it is possible to prevent unnecessary application of the material for overcoat layers 104, and appropriately form overcoat layers 104 having uniform thickness with respect to specific necessary region. Therefore, according to the present example, it is possible to appropriately form overcoat layers 104 with high accuracy while suppressing an unnecessary increase in the cost.

Also, as described above, in the present embodiment, the time lag until clear ink is applied on a colored ink layer 102 is set by adjusting the distance between the head 14 for clear ink and the head 12 for color ink, such that the colored ink is sufficiently dried before it is covered with clear ink. Therefore, according to the present example, for example, it is possible to appropriately suppress bleeding from occurring in colored ink layers 102.

Further, in the present example, since the pre-heater 32 is used, it is possible to appropriately increase the heating temperature at the landing position of colored ink ejected from the head 12 for color ink. Also, in this way, for example, it is possible to appropriately dry colored ink immediately after landing. Therefore, according to the present example, it is possible to more appropriately suppress bleeding from occurring in colored ink layers 102.

Also, the printing device 10 has components identical or similar to those of well-known inkjet printers, except for points described above or to be described below. For example, the printing device 10 may further include a control unit, a main scan drive unit, a sub scan drive unit, and the like, in addition to the above-described components. In this case, the control unit is, for example, a CPU of the printing device 10, and controls the operation of each unit of the printing device 10. Also, the main scan drive unit and the sub scan drive unit are, for example, drive units for driving the head 12 for color ink and the head 14 for clear ink to perform main scan operations and sub scan operations. The main scan drive unit may be, for example, a part including a carriage for holding the head 12 for color ink and the head 14 for clear ink, a guide rail for moving the carriage in the main scan direction, and the like. Also, the sub scan drive unit may be, for example, a motor or the like for rotating the winding roller 42.

Now, the heating temperatures of the heaters such as the after-heater 36 will be described in more detail. In the present example, the after-heater 36 heats a medium 50 such that the temperature of an overcoat layer 104 becomes a temperature equal to or higher than a glass-transition point. In this case, a state where the temperature of an overcoat layer 104 is equal to or higher than the glass-transition point means a state where the temperature of the material (such as a resin) of the overcoat layer 104 is equal to or higher than the glass-transition point of that material. According to this configuration, for example, it is possible to appropriately and sufficiently fix a colored ink layer 102 and an overcoat layer 104 to a medium 50 by performing sufficient heating after formation of the overcoat layer 104.

Also, a glass-transition point can be defined, for example, as a temperature Tg at which glass transition occurs in an amorphous solid material. More specifically, for example, with respect to an amorphous solid material which is composed of a material which has a hard crystal state and substantially does not flow at low temperature, and has rigidity and viscosity which suddenly decrease in a certain narrow temperature range if the amorphous solid material is heated, such fluidity increases, a temperature at which this change occurs is a glass-transition point. At a temperature higher than the glass-transition point, the solid material becomes, for example, a liquid state or a rubber state. With respect to the material for overcoat layers 104, the glass-transition point can be appropriately confirmed, for example, by experiments and the like. Also, with respect to a certain substance which is used as the material for overcoat layers 104, a theoretical value may be calculated, for example, by calculation or the like. Also, in the present example, the glass-transition point is, for example, about 70° C.

Also, for example, it can be considered to perform heating of overcoat layers 104 to a temperature equal to or higher than the glass-transition point by a heater other than the after-heater 36. For example, the far-infrared heater 38, the platen heater 34, or the like may be used to perform heating of overcoat layers 104 to a temperature equal to or higher than the glass-transition point. Even in this configuration, for example, it is possible to appropriately and sufficiently fix a colored ink layer 102 and an overcoat layer 104 to a medium 50 by performing sufficient heating after formation of the overcoat layer 104.

Also, as described above, in the present example, after heating of the after-heater 36 and the like, media 50 are cooled by the cooling fan 44. Also, as a result, the winding roller 42 winds each medium 50 having, for example, a state where the temperature of an overcoat layer 104 is a temperature lower than the glass-transition point.

Also, a situation where the winding roller 42 winds a medium 50 having a state where the temperature of an overcoat layer 104 is a temperature lower than the glass-transition point means a situation where the winding roller 42 winds the medium 50 having a state where the temperature of a portion to be wound on the winding roller (a wound portion) is a temperature lower than the glass-transition point. Also, during winding, the temperature of an overcoat layer 104 may be, for example, the temperature of the surface of the overcoat layer 104.

In the above-described configuration, it is possible to appropriately fix an overcoat layer 104 to a medium 50 by sufficiently perform heating by the after-heater 36 and the like, for example, after formation of the overcoat layer 104. Also, thereafter, the temperature of the overcoat layer 104 is sufficiently lowered, and then the medium 50 is wound, whereby it is possible to appropriately suppress problems such as blocking.

Therefore, according to the present example, for example, it is possible to more appropriately form overcoat layers 104. Also, as a result, for example, it is possible to appropriately protect printing surfaces having colored ink layers 102, and appropriately prevent color deterioration and blemishes. Also, for example, since colorless and transparent overcoat layers 104 are formed, it is possible to improve glossiness, and improve image quality.

Also, in the present example, after formation of an overcoat layer 104, for example, it is possible to heat a medium 50 at a sufficiently high temperature, thereby drying the overcoat layer 104 in a short time. Therefore, for example, it can also be considered to increase the thickness of overcoat layers 104. More specifically, for example, it can be considered to perform a plurality of (for example, two) main scan operations on each area of a medium 50 by the head 14 for clear ink, thereby forming a plurality of (for example, two) overcoat layers 104. According to this configuration, for example, it is possible to further improve the weather resistance of overcoat layers 104.

Also, in this case, with respect to a certain number of overcoat layers 104 to be formed, for example, it is preferable to set the length of the head 14 for clear ink in the sub scan direction so as to be longer than that of the head 12 for color ink. According to this configuration, for example, it is possible to appropriately form a plurality of overcoat layers 104 on one colored ink layer 102.

Also, in order to more appropriately dry overcoat layers 104, it can be considered to change a passage time for which a medium 50 passes on the heaters (such as the after-heater 36), for example, on the basis of the application amount of clear ink. For example, in a case of increasing the application amount of clear ink or the like in order to improve the weather resistance of overcoat layers 104, if a medium 50 is conveyed on the heaters in a short time in order to perform high-speed printing, it is feared that the medium may not be sufficiently dried. For this reason, for example, a method of changing the printing speed, a method of changing the heating time according to the application amount of clear ink or the like by changing the lengths of heating areas of the heaters (the lengths in the sub scan direction), and the like can also be considered. According to this configuration, it is possible to more appropriately dry overcoat layers 104, for example, before winding of the winding roller 42.

Now, the reason why the powder is dispersed toward media 50 in the present example, and a more specific configuration of the serial powdering unit 62 of the powdering device 60 will be described. First, the reason which the powder is dispersed will be described.

The inventors of this application found out that in a case of winding a heated medium 50 by the winding roller 42, if the powder is dispersed toward the medium 50 before the winding position, it is possible to more appropriately suppress problems such as blocking, by earnest research. Also, on the basis of this finding, in the printing device 10, the powdering device 60 is installed at a stage prior to the winding roller 42. According to this configuration, it is possible to more appropriately wind a medium 50, for example, after formation of an overcoat layer 104.

Also, in this case, for example, if the powder is dispersed toward a medium 50 after cooling from a state where the temperature of an overcoat layer 104 is a temperature equal to or higher than the glass-transition point, it is possible to more appropriately suppress blocking. To this end, in the present example, the powdering device 60 disperses the powder toward media 50 having, for example, a state where the temperatures of overcoat layers 104 are less than the glass-transition point.

Figure 2A:
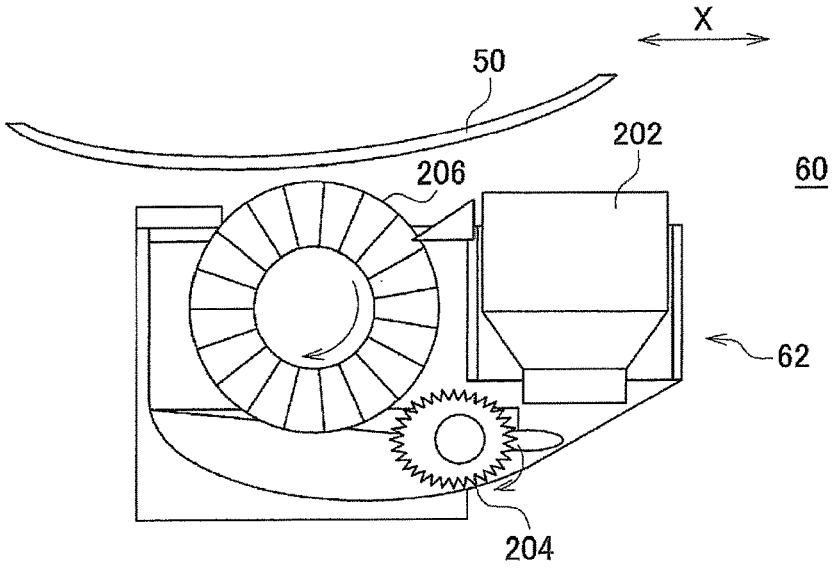
FIGS. 2A-2B are views illustrating an example of a more detailed configuration of a serial powdering unit 62.
Figure 2B:
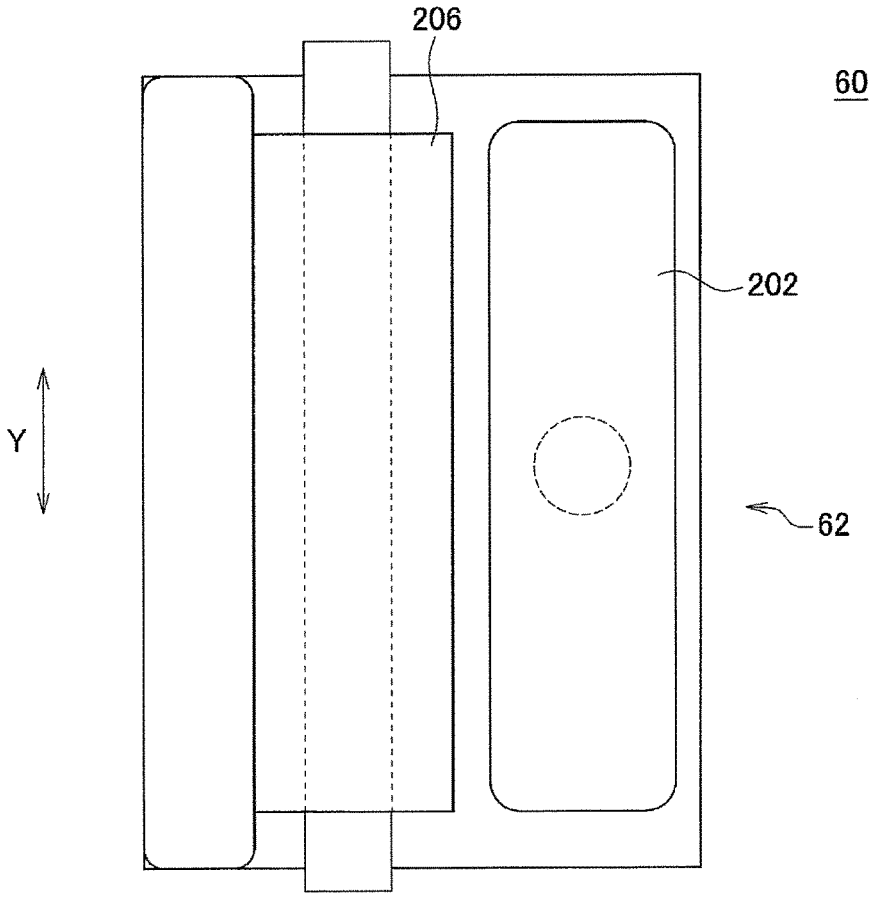

Now, a more specific configuration of the serial powdering unit 62 of the powdering device 60 will be described. FIGS. 2A-2B show an example of a more specific configuration of the serial powdering unit 62. FIG. 2A is a sectional side view of the serial powdering unit 62, and shows an example of the state of a cross section of the serial powdering unit 62 along a plane perpendicular to a medium 50 at the position where the powder is dispersed. FIG. 2B is a top view of the serial powdering unit 62, and shows an example of the state of the serial powdering unit 62 as seen from the side where a medium 50 is positioned. In the present example, the serial powdering unit 62 includes a powder container 202, a feeding/stirring roller 204, and a powdering roller 206.

The powder container 202 is a container for storing the powder to be dispersed toward media 50, and subsequently feeds the powder toward the feeding/stirring roller 204. It is preferable to use an exchangeable container as the powder container 202. The feeding/stirring roller 204 is a roller for subsequently feeding the powder fed from the powder container 202 toward the powdering roller 206, and feeds the powder by rotating, vibrating, or the like, for example, if sensing a decrease in the amount of powder to be dispersed by the powdering roller 206. It is possible to suitably use, for example, a roller having a transverse groove, an oblique slit, or a screw structure, as the feeding/stirring roller 204.

The powdering roller 206 is a roller for dispersing the powder toward media 50. It is possible to suitably use, for example, a fabric roller, a brush roller, or the like, as the powdering roller 206. In this case, a brush roller is, for example, a roller having a toothbrush-like surface. Also, the powdering roller 206 disperses the powder toward media 50, for example, by rotating, a combination of rotating and forward and backward vibrating, or the like.

In a case of using the above-described configuration, it is possible to appropriately disperse the powder toward a medium 50, for example, after formation of an overcoat layer. Also, in this way, it is possible to more appropriately suppress blocking and the like during winding. Therefore, according to this configuration, it is possible to more appropriately wind media 50, for example, after formation of overcoat layers.

Also, in a case of producing large-sized printed matters to be wound after printing, in the configuration of the related art, for example, there is a case of protecting the printed matters by a method of forming protective layers of laminated films or the like (film laminating). With respect to this, in a case of dispersing powder as described above, it is difficult to perform, for example, general film laminating or the like after dispersing of the powder. However, in the present example, before dispersing of the powder is performed, an overcoat layer is formed by the head 14 for clear ink. Therefore, it is possible to appropriately protect printed matters, without performing film laminating or the like. Also, as a result, for example, it is possible to install printed matters outdoors and at places where people gather, as they are. Further, since dispersing of the powder is performed, for example, it is possible to suppress stains such as fingerprints.

Also, in the case of performing dispersing of the powder, more specifically, for example, it is especially preferable to disperse the powder under the following conditions. For example, it is preferable to synchronize the operation of the powdering device 60 with the speed of printing using the head 12 for color ink and the like, such that the serial powdering unit 62 passes over each part of print areas of media 50 at least once. Also, it is more preferable to set the number of passages of the serial powdering unit 62 over each part to two or more.

Also, in view of the deviation between the position of the head 12 for color ink or the like and the position of the powdering device 60 in the sub scan direction, it is preferable to perform the operation of the serial powdering unit 62 later than main scan operations of the head 12 for color ink and the like by a time corresponding to the deviation. Also, for example, in order to prevent the printing surface of a medium 50 from becoming mat due to adhesion of an excessive amount of powder to the medium 50, it is preferable to set the installation position of the serial powdering unit 62 to the rear side (on the downstream side in the conveyance direction of media 50) from a position where 85% or more of the solvent (including water) contained in ink on the medium 50 evaporates. In this case, the solvent contained in the ink on the medium 50 means, for example, an evaporable solvent component contained in the ink of a colored ink layer 102 and an overcoat layer 104. Also, the amount of evaporation of the solvent (the fluxing material) can be measured, for example, on the basis of the rate of decrease in the solvent on the medium 50.

Until now, the configuration in the case of dispersing the powder on the rear surface side of a medium 50 has been described. However, for example, it can also be considered to perform dispersing of the powder on the printing surface side of a medium 50. Therefore, now, a configuration in a case of dispersing the powder on the printing surface side of a medium 50 will be described.

Figure 3:
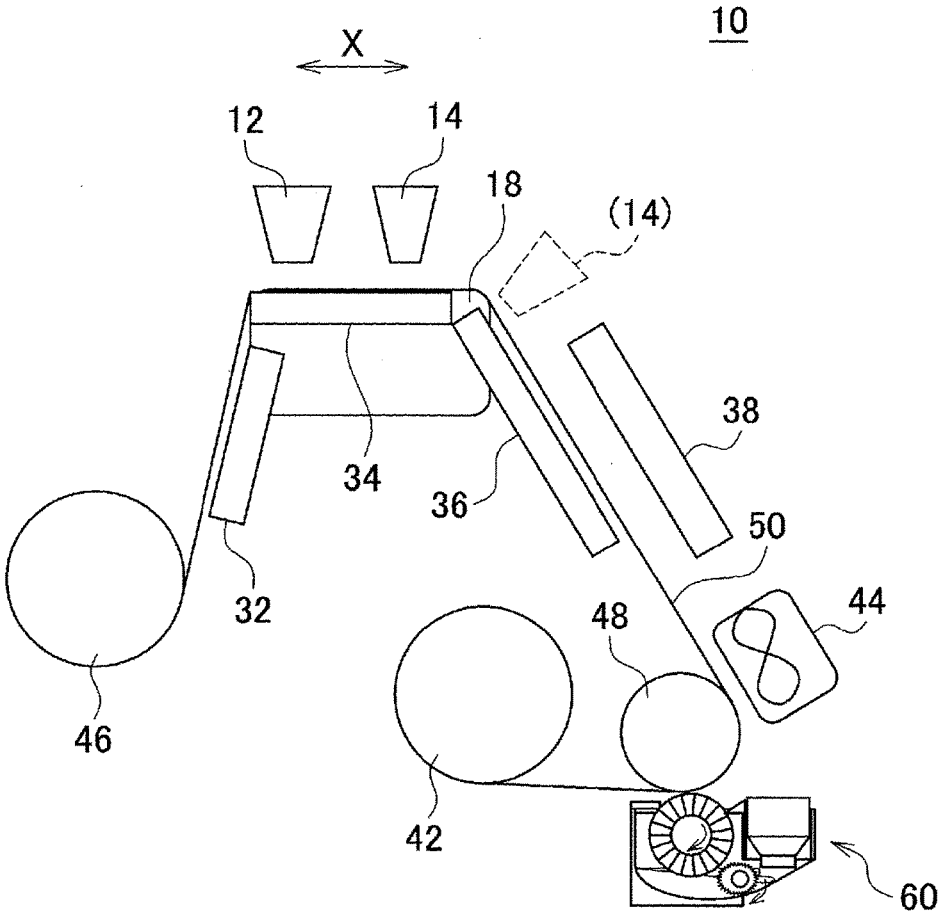
FIG. 3 is a view illustrating another example of the configuration of the printing device 10.

FIG. 3 is a view illustrating another example of the configuration of the printing device 10, and shows an example of the configuration of a main part of the printing device 10 with respect to the case of dispersing the powder toward the printing surface of a medium 50. Also, the printing device 10 shown in FIG. 3 has features identical or similar to those of the printing device 10 described with reference to FIGS. 1A-1C and FIGS. 2A-2B, except for points to be described below. Also, in FIG. 3, components denoted by the same reference symbols as those of FIGS. 1A-1C or FIGS. 2A-2B have features identical or similar to those of the components shown in FIGS. 1A-1C or FIGS. 2A-2B, except for points to be described below.

As described above, in the configuration shown in FIG. 3, the powder is dispersed toward the printing surface of a medium 50. To this end, the intermediate roller 48 supports a medium 50 such that the printing surface of the medium 50 faces the powdering device 60. In this case, the powdering device 60 disperses the powder toward the printing surface of the medium 50. Also, on the basis of the surface toward the powder is dispersed, the cooling fan 44 is installed on the printing surface side of the medium 50. According to this configuration, for example, it is possible to more appropriately cool areas toward which the powder is dispersed.

Even in the above-described configuration, it is possible to appropriately fix an overcoat layer 104 to a medium 50, for example, by heating the medium 50 such that the temperature of the overcoat layer 104 becomes a temperature equal to or higher than the glass-transition point. Also, it is possible to appropriately suppress problems such as blocking during winding, by winding a medium 50 having a state where the temperature of an overcoat layer 104 is a temperature lower than the glass-transition point, by the winding roller 42. Further, it is possible to more appropriately suppress problems such as blocking by dispersing the powder toward a medium 50 after formation of an overcoat layer 104. Therefore, even in this case, it is possible to appropriately wind the medium 50, for example, after formation of the overcoat layer 104.

Also, it can be considered to further modify the configuration of the printing device 10, for example, as will be described below. For example, it can be considered to set the positional relation between the head 12 for color ink and the head 14 for clear ink to a positional relation in which they are farther from each other as shown by a broken line in FIG. 3. Also, this positional relation is not limited to the case shown in FIG. 3, and may be applied to, for example, the individual components described with reference to FIGS. 1A-1C.

Also, ink which is ejected from the head 12 for color ink is not limited to specific colors. For example, besides only Y, M, C, and K ink, metallic, white, pearl, and fluorescent colors may be used. Also, an inkjet head for color ink (a head for color ink) is not necessarily used as the head for colored ink for drawing images below overcoat layers 104, and an inkjet head for a single color may be used.

Also, for example, in a case of seeing the invention with a focus on the features for suppressing blocking during winding of a medium 50, it can be considered to form only a colored ink layer 102, without necessarily forming an overcoat layer 104. In this case, for example, from the configuration of the printing device 10 shown in FIGS. 1A-1C or FIG. 3, the head 14 for clear ink may be omitted. In this case, the heaters (such as the after-heater 36) heat a medium 50 such that the temperature of a colored ink layer 102 becomes a temperature equal to or higher than the glass-transition point. In this way, for example, it is possible to appropriately and sufficiently dry the colored ink layer 102 in a short time. Also, thereafter, the winding roller 42 winds the medium 50 having a state where the temperature of the colored ink layer 102 is low threshold the glass-transition point. According to this configuration, for example, it is possible to appropriately suppress blocking and the like during winding. Also, in this way, it is possible to appropriately form a colored ink layer 102 on a medium 50 which can be wound in a roll shape after printing.

Also, for example, in a case of seeing the invention with a focus on the point in which powder is dispersed after formation of an overcoat layer 104 and a medium 50 is wound, as a component for forming an overcoat layer 104, components other than inkjet heads, such as a spray, a bubble jet head, a liquid coater, and the like can be considered. Even in this case, it is possible to appropriately and sufficiently dry an overcoat layer 104 in a short time, for example, by heating a medium 50 such that the temperature of the overcoat layer 104 becomes a temperature equal to or higher than the glass-transition point. Also, thereafter, the medium 50 having a state where the temperature of the overcoat layer 104 is lower than the glass-transition point is wound, whereby it is possible to appropriately suppress blocking and the like during winding. Also, in this way, it is possible to appropriately an overcoat layer 104 or the like on a medium 50 which can be wound in a roll shape after printing.

Although the present invention has been described above by way of the embodiment, the technical scope of the invention is not limited to the scope described in the embodiment. It is apparent to those skilled in the art that it is possible to make various changes or modifications in the above described embodiment. It is apparent from a description of claims that forms obtained by making such changes or modifications can also be included in the technical scope of the disclosure.

INDUSTRIAL APPLICABILITY

The present invention can be suitably used, for example, in printing devices.

The invention claimed is:

1. A printing device for performing printing on a medium, comprising:

a printing head configured to form an ink layer on the medium;

a heater configured to heat the medium having the ink layer formed thereon;

a medium winding unit configured to wind the medium heated by the heater; and a powdering device installed between the heater and the medium winding unit, and configured to disperse powder toward the medium before the medium is wound by the medium winding unit, wherein the heater heats the medium such that a temperature of the ink layer becomes a temperature equal to or higher than a glass-transition point, and the medium winding unit winds the medium having a state where the temperature of the ink layer is a temperature lower than the glass-transition point.

2. The printing device according to claim 1, wherein the printing head is an inkjet head configured to eject ink drops toward the medium.

3. The printing device according to claim 1, wherein the printing head forms the ink layer to be fixed to the medium by drying, on the medium.

4. The printing device according to claim 1, wherein the printing head is an overcoat head configured to form an overcoat layer which is an ink layer covering an image drawn on the medium with colored ink.

5. The printing device according to claim 4, wherein the printing head includes:

a head for colored ink which is a printing head configured to draw an image on the medium with color ink; and the overcoat head, the heater heats the medium such that a temperature of the overcoat layer becomes a temperature equal to or higher than the glass-transition point, and the medium winding unit winds the medium having a state where the temperature of the overcoat layer is a temperature lower than the glass-transition point.

6. The printing device according to claim 4, wherein the overcoat head forms a clear ink layer, as the overcoat layer, on the medium.

7. The printing device according to claim 4, wherein the overcoat head forms an ink layer containing an ultraviolet absorbing agent absorbing ultraviolet light, as the overcoat layer, on the medium.

8. The printing device according to claim 7, wherein the overcoat head forms a layer of latex ink or solvent ink, as the overcoat layer, on the medium.

9. The printing device according to claim 4, wherein the overcoat head forms a layer of latex ink or solvent ink, as the overcoat layer, on the medium.

10. A printing method of performing printing on a medium, comprising:

forming an ink layer on the medium by a printing head;

heating the medium having the ink layer formed thereon, by a heater;

winding the medium heated by the heater, by a medium winding unit; and installing a powdering device between the heater and the medium winding unit, and dispersing powder toward the medium before the medium is wound by the medium winding unit, wherein the heater heats the medium such that a temperature of the ink layer becomes a temperature equal to or higher than a glass-transition point, and the medium winding unit winds the medium having a state where the temperature of the ink layer is a temperature lower than the glass-transition point.

11. A printing device for performing printing on a medium, comprising:

an overcoat head which is a printing head configured to form an overcoat layer which is an ink layer covering an image drawn on the medium with colored ink;

a heater configured to heat the medium having the ink layer formed thereon;

a medium winding unit configured to wind the medium heated by the heater; and a powdering device installed between the heater and the medium winding unit, and configured to disperse powder toward the medium before the medium is wound by the medium winding unit, wherein the overcoat head forms the ink layer containing an ultraviolet absorbing agent absorbing ultraviolet light, as the overcoat layer, on the medium.

12. The printing device according to claim 11, wherein the overcoat head forms a layer of latex ink or solvent ink, as the overcoat layer, on the medium.

* * * * *